US005178733A

United States Patent [19]

Nielson

[11] Patent Number: 5,178,733

[45] Date of Patent: Jan. 12, 1993

[54] APPARATUS FOR SEPARATING OIL AND PRECIOUS METALS FROM MINED OIL-BEARING ROCK MATERIAL

[76] Inventor: Jay P. Nielson, 3490 Monte Verde Dr., Salt Lake City, Utah 84109

[21] Appl. No.: 724,910

[22] Filed: Jul. 2, 1991

Related U.S. Application Data

[62] Division of Ser. No. 542,816, Jun. 25, 1990, Pat. No. 5,122,259.

[51] Int. Cl.[5] ..... B01D 11/02

[52] U.S. Cl. ..... 202/84; 196/14.52; 422/255; 422/271; 422/275

[58] Field of Search ..... 196/14.52, 46, 46.1; 202/84, 99, 100, 208, 226; 201/3; 210/364, 377, 379, 382; 422/255, 271, 275, 289

[56] References Cited

U.S. PATENT DOCUMENTS

| | | | |
|---|---|---|---|
| 2,878,943 | 3/1959 | Ziherl | 210/377 |
| 3,256,994 | 6/1966 | Koelsch | 210/377 |
| 3,684,098 | 8/1972 | Bentley et al. | 210/377 |
| 4,088,562 | 5/1978 | O'Ffill | 196/46.1 |
| 4,502,919 | 5/1985 | Brunner et al. | 196/14.52 |
| 4,588,476 | 5/1986 | Warzel | 196/14.52 |
| 4,741,807 | 5/1988 | Wilhelm et al. | 196/14.52 |

OTHER PUBLICATIONS

Chemical Engineering Handbook, 5th Edition, Robert H. Parry and Cecil H. Chilton, McGraw Hill, New York, 1973, pp. 19-91 through 19-93; 19-97 through 19-98.

Flow Chart for Aostra Taciuk Processor, Alberta Oil Sands Technology and Research Authority, No. 500 Highland Place, 10010-106 Street, Edmonton, Alberta, T5J 3L8.

*Primary Examiner*—Joye L. Woodard

*Attorney, Agent, or Firm*—Mallinckrodt & Mallinckrodt

[57] ABSTRACT

A method and apparatus for producing oil, bitumen, precious metals, and hydrocarbon gases from mined oil-bearing rock material, such as tar sands and soil shale. The rock is ground, preconditioned in a heated and pressurized atmosphere devoid of oxygen, and subsequently centrifuged in the presence of an oil-replacement gas to produce oil, and also any precious metal particles that are present in the oil-bearing rock material. The produced oil and precious metals are subsequently separated from each other by centrifuging.

24 Claims, 6 Drawing Sheets

SOLVENT
0621
1250
1301
AIR
$CO_2$
LIGHT GASES
HEAVY GASES
OIL
CHK
V

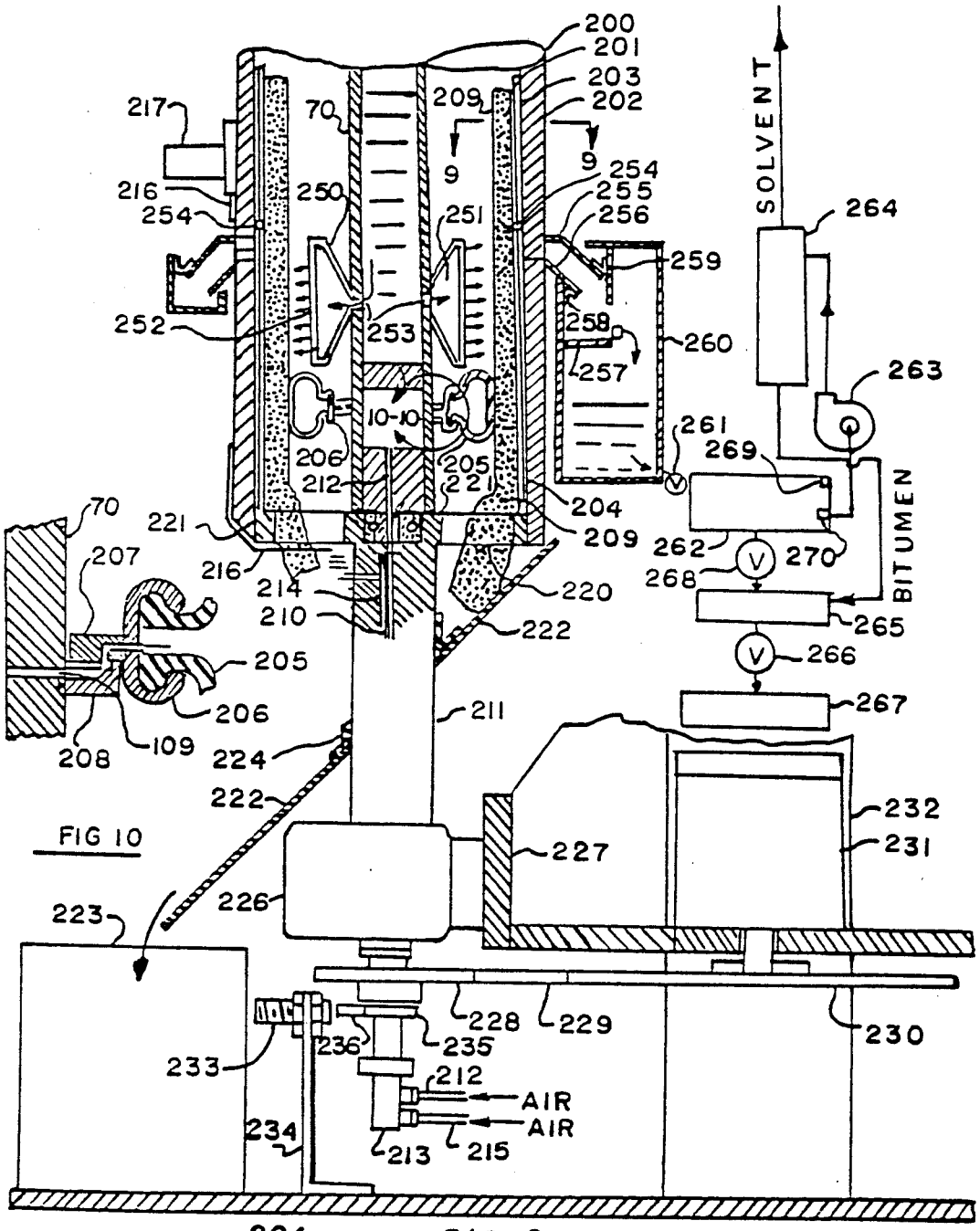
FIG 10
FIG 8
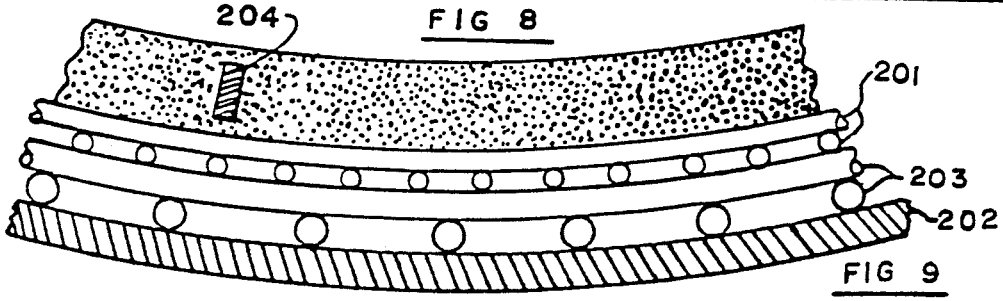
FIG 9

APPARATUS FOR SEPARATING OIL AND PRECIOUS METALS FROM MINED OIL-BEARING ROCK MATERIAL

This application is a division of application Ser. No. 07/542,816, filed Jun. 25, 1990, now U.S. Pat. No. 5,122,259.

BACKGROUND OF THE INVENTION

1. Field

The invention is in the field of methods and apparatus for the production of oil and associated precious metals from mined oil-bearing rock material, especially the production of bitumen from tar sands and of kerogen products from oil shale.

2. State of the Art

In most instances, oil is produced from underground oil-bearing rock material by in situ methods which involve drilling thereinto, and by sometimes applying secondary or tertiary methods of recovering the oil from interstices of the underground formation. Oil-bearing rock material consists primarily of rock material having sedimentary organic matter in the form of petroleum or kerogen interspersed between the particles of rock which may be consolidated or unconsolidated.

Some oil-bearing deposits, commonly called tar sands, consist of oil-bearing rock material containing petroleum, wherein the petroleum is composed primarily of heavy hydrocarbons called bitumen, the lighter hydrocarbons having been mostly driven out at some previous time. (Tar sands is a misnomer since the organic matter is not tar and the rock may not be sand.) Bitumen has a very high viscosity, which is generally not compatible with in-situ production methods, and, thus, efforts to produce oil from tar sands by such methods are generally not economical (although, one promising method is that disclosed in Nielson, U.S. Pat. No. 4,856,587).

Bitumen is a very valuable binder product for hard-surfacing highways. Currently, it is state-of-the-art to utilize the residue from oil-cracking plants as a binder to mix with sand to produce a surfacing product. However, modern oil-cracking technology has progressed to the point that the residue is largely denuded of its binding characteristics. Standard tests have shown that the bitumen from some deposts, such as those of Asphalt Ridge, Utah, stretch 100 cm whereas the conventional binders stretch only 8 to 15 cm. This superior stretching characteristic of bitumen makes the road surface much more resistant to cracking under extreme temperature variations. Since it is reported that 60% of the highways in the U.S. need to be resurfaced and new highways are continually needed, the potential market for bitumen is obvious.

Another important consideration is that some deposits of tar sand, such as those of Asphalt Ridge, Utah, and P. R. Springs, Utah, are reported to contain commercial quantities of microscopic particles of precious metals such as gold, silver, platinum, palladium, and others. Consequently it would be highly desirable to have a production method for the bitumen which would also recover the precious metals.

For some deposits the tar sands are sufficiently close to the surface that they can be mined. For such deposits, the tar sands are mined and the bitumen subsequently produced by various methods.

One such method involves heating the tar sands in a retort operated at a temperature high enough to volatilize the bitumen. Typical of this method is the LURGI-RUHR GAS (L-R) process. In this process, hot spent sand is used as a fine-grained heat carrier to volatilize the bitumen. The spent sand is heated to 1200° F. and mixed with fresh tar sand at a ratio of five parts hot spent sand to one part fresh tar sand. Most of the bitumen is volatilized in the mixing bin and must then be recovered by a condensation process. This method does not recover precious metals that may reside in the tar sands.

Another method is known as the "cold water" or "ambient temperature" flotation process. In this process, tar sand, water, and flotation reagents are fed into a semi-autogenous grinding (SAG) mill. Discharge from the SAG mill is split and ground to a required fineness in a rod mill. Slurry from the rod mill is then agitated and fed to a flotation plant having rougher-scavengers and a three-stage cleaning circuit which produces a bitumen concentrate. So far as is known, no provision is made for the recovery of precious metals.

Still another method is known as the "hot water" extraction process, which utilizes hot water rather than cold water. The resulting bitumen slurry is then mixed with a diluent and passed through a centrifuge to remove entrained matter and free water. The diluent is then removed by heating the mixture to about 600° F. and distilling it, thus producing a bitumen concentrate. So far as is known, no provision is made for the recovery of precious metals.

Oil shale is a nomenclature commonly applied to oil-bearing rock containing organic matter in the form of kerogen. (Oil shale is a misnomer since the organic matter is not in the form of oil and the rock may not be shale.) Kerogen is a solid having a very complicated long-chain molecular structure, which may be converted to oil, various gases, and a solid residue by pyrolysis at temperatures usually exceeding 900° F.

Pyrolysis is sometimes performed on in-situ deposits and sometimes on mined rock material. The normal procedure involves volatilizing the oil products resulting from pyrolysis and later fractionating and condensing them. One such process is the Aostra Taciuk process developed by William Taciuk of UMATAC Industrial Processes. However, this process volatilizes essentially all of the hydrocarbons, producing little, if any bitumen. This method is not amenable to the recovery of precious metals.

A very significant problem associated with the production of oil from mined oil-bearing rock material, whether tar sands or oil shale, is the disposition of the spent rock after the production of the oil. Typically, the spent rock still has a significant amount of residual oil remaining with it. The sheer volume of such rock constitutes an environmental problem of major proportions that must be carefully addressed when disposing of such rock.

SUMMARY OF THE INVENTION

The invention is both a method and apparatus for the continuous production of oil from mined oil-bearing rock material, particularly, but not exclusively, including the production of bitumen from tar sands and oil shale; for recovering gaseous hydrocarbons produced concurrently with the oil, particularly those produced from oil shale; for producing precious metals initally contained in the oil-bearing rock materials; and for discharging the spent rock in an oil-free state so as to avoid pollution. There is presently no known method or apparatus which accomplishes all these objectives in an economical fashion.

The method of the invention employs a thermal preconditioning process followed by a centrifuging operation cooperating with a pressurized oil-replacement gas, all in a continuous process.

In this invention, oil-bearing rock material is ground as needed, purged of air, and then heated in a rotary kiln, by means of a heated conditioning gas, in an environment substantially devoid of oxygen. The conditioning gas may be carbon dioxide, nitrogen, flue gas, natural gas, or other gaseous hydrocarbons.

When processing oil-bearing rock material containing petroleum, the conditioning gas, preferably carbon dioxide, is introduced into the kiln at a temperature preferably of approximately 600° to 800° F. and at a pressure preferably of approximately 210 psi, although these values may be higher or lower. The spent carbon dioxide exits the kiln at a temperature preferably of approximately 450° F. and a pressure preferably of approximately 200 psi, although these values may be higher or lower, and is rejuvenated by being repressurized and reheated, and is then recycled. Dwell time of the oil-bearing rock material in the kiln is adjusted so as to heat the oil-bearing rock material to approximately 200° to 400° F. Preferably, the temperature and pressure are adjusted such that any film of connate water which may surround each particle, or grain of sand, such as is found in some deposits, is not evaporated. Typical values are 200 psi and 380° F., or 50 psi and 250° F., for oil-bearing rock material containing principally bitumen. These values may be somewhat different for other oil-bearing rock materials. Maintenance of the water film is beneficial in that it inhibits adhesion of the oil to the rock. However, the temperature and pressure are also maintained high enough to materially reduce the viscosity of the oil, especially if it is bitumen. The viscosity reduction is further enhanced by the dissolving or absorbing of the conditioning gas into the oil.

When processing oil-bearing rock material containing kerogen, the conditioning gas (preferably comprised of hydrocarbons produced in the process) is introduced into the kiln at a temperature preferably of approximately 1000° F. to 1200° F., and at a pressure preferably of approximately 50 psi to 210 psi. The spent conditioning gas exits the kiln at a temperature preferably of approximately 900° F. to 1000° F. and at a pressure preferably of approximately 50 psi to 200 psi and is repressurized, reheated, and recycled. Dwell time of the oil-bearing rock material in the kiln is adjusted so as to heat the rock to approximately 900° F., being preferably just high enough to convert most of the kerogen to bitumen and other hydrocarbons, but not so high as to volatilize the bulk of the bitumen.

The heated oil-bearing rock material exiting the kiln is then introduced into a vertically oriented centrifuge operating at a speed ranging from 100 RPM to 4,000 RPM, the specific speed being dependent on the particular oil-bearing rock material being processed. In most instances, 1000 RPM should be adequate. A concentric feed screw conveyor, operating at a somewhat different speed than the centrifuge, is incorporated to transport the rock from the top to the bottom of the centrifuge. The required dwell time of the rock in the centrifuge is a function of the oil viscosity and the permeability of the rock material and also of the physical characteristics of the centrifuge.

In addition, means are provided for subjecting the oil-bearing rock material in the centrifuge to a pressurized oil-replacement gas, for reasons explained below. Such means may comprise a concentric sparger which sprays oil-replacement gas against the rock material or, alternatively, may comprise means for conducting at least some of the conditioning gas from the kiln into the centrifuge after exiting the kiln.

The centrifuge incorporates an inner wall and a spaced-apart outer wall. The inner wall incorporates transverse apertures that are large enough to allow the oil to be forced therethrough by centrifugal force but small enough to prevent most of the particles of rock from passing therethrough. The oil-replacement gas is incorporated so as to permeate the rock and replace the oil as the oil is forced out from the voids in the rock, leaving substantially depleted or spent rock behind. The oil-replacement gas will normally be the same type of gas, and at substantially the same temperature and pressure as the spent conditioning gas, although not necessarily so.

As an option, the substantially depleted rock in the lower portion of the centrifuge is sprayed with a solvent so as to dissolve or mix with any residual oil remaining in the rock.

The spent rock exits the bottom of the centrifuge. Oil-replacement gas that exits along with the spent rock is largely recovered and recycled.

The produced oil, including any associated microscopic particles of precious metals, is recovered from the space between the walls of the centrifuge, is depressurized and cooled, and is then collected for further processing or distribution. The produced hydrocarbon gases are recovered by separation in gas cyclones or centrifuges. As an option, the produced oil is further centrifuged to recover any precious metals that may be contained therein and to remove unwanted sand and clay.

As an option, one or more high frequency vibrators may be attached to the inner wall of the centrifuge and/or to the feed screw conveyor. This will result in vibration of the oil-bearing rock and the spent rock, thus facilitating the progression of the rock through the centrifuge. In addition, the rate of flow of the oil through the oil-bearing rock material will be enhanced.

THE DRAWINGS

The best mode presently contemplated for carrying out the invention is illustrated in the accompanying drawings, in which:

FIG. 1 is a schematic presentation of the invention in terms of a flow sheet identifying component items of equipment;

FIG. 2, a vertical section, partly in elevation, through apparatus conforming to the flow sheet of FIG. 1;

FIG. 3, a vertical section taken along the line 3—3 of FIG. 2 and drawn to a larger scale;

FIG. 4, a horizontal section taken along the line 4—4 of FIG. 2 and drawn to a larger scale;

FIG. 5, a horizontal section taken along the line 5—5 of FIG. 2 and drawn to a larger scale;

FIG. 6, a horizontal section taken along the line 6—6 of FIG. 2 and drawn to a larger scale;

FIG. 7, a vertical section taken along the line 7—7 of FIG. 2 and drawn to a larger scale;

FIG. 8, a vertical section partly in elevation showing the lower end of the centrifuge of an alternate embodiment;

FIG. 9, a horizontal section taken along the line 9—9 of FIG. 8 and drawn to a larger scale;

FIG. 10, an enlarged view of that portion of FIG. 8 enclosed by the line 10—10, showing the sliding support and air feed to the pneumatic seal;

DETAILED DESCRIPTION OF THE ILLUSTRATED EMBODIMENTS

Figure 1:
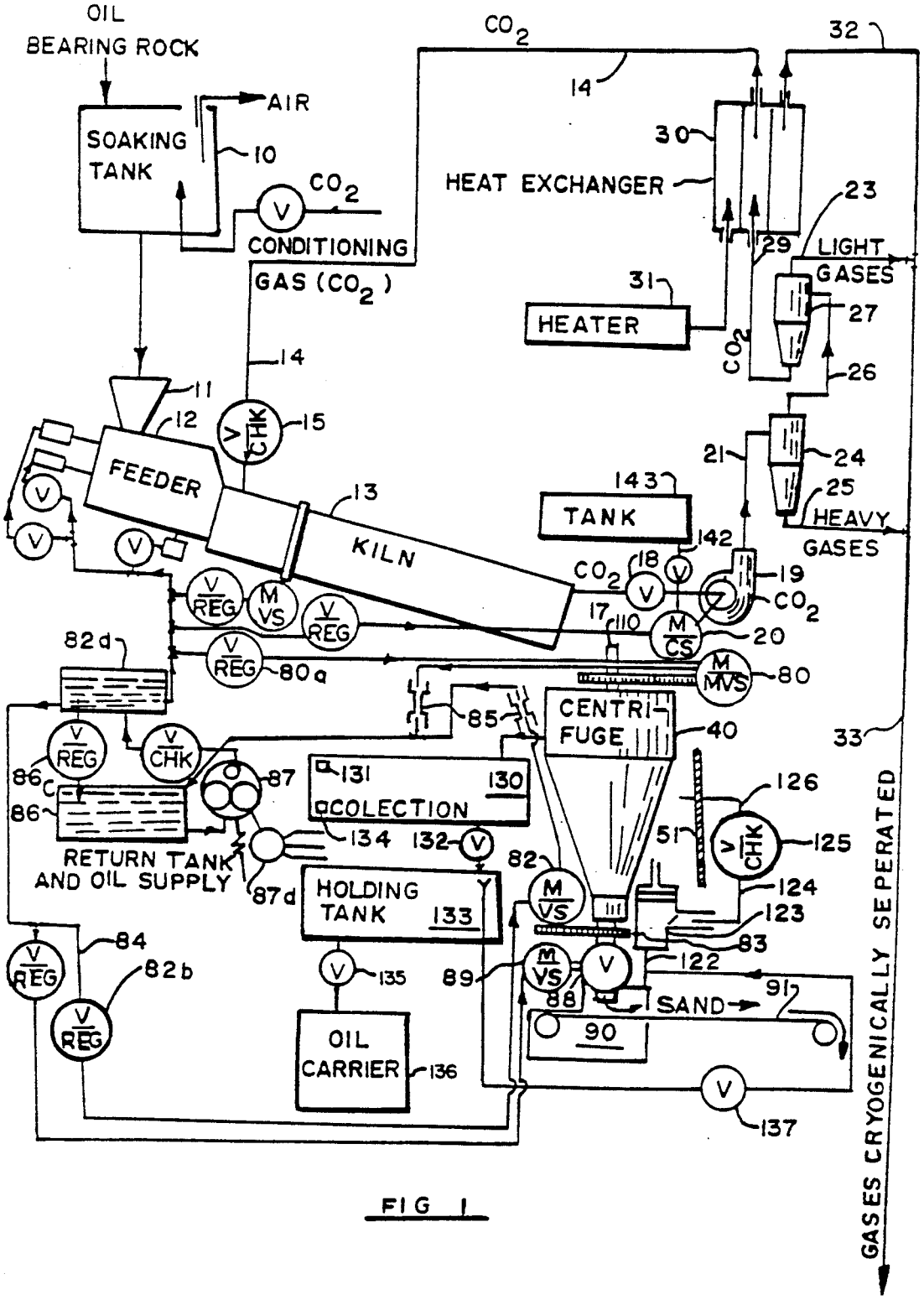

The rock material, whether it be tar sand, oil shale, or other oil-bearing rock, is subjected to crushing after mining to reduce it to approximately pea size or finer and is introduced into a soaking tank 10, FIG. 1, along with a conditioning gas, e.g. carbon dioxide ($CO_2$). The $CO_2$, being heavier than air, will displace any entrained air in the pores of the rock material and will force it out of the top of the tank. The rock material, now being substantially free of oxygen, is introduced through hopper 11 and feeder 12 into kiln 13. Hopper 11 and tank 10 may be combined. Kiln 13 is a sloping rotary kiln which may be configured as described in Nielson, U.S. Pat. No. 4,829,911, although other types of kilns may be used. Heated and pressurized conditioning gas, such as carbon dioxide ($CO_2$), nitrogen ($N_2$), flue gas, natural gas, or light hydrocarbons having one to six atoms of carbon in each molecule ($CH_4$—$C_6H_{10}$), is also introduced into kiln 13 by way of conduit 14 and check valve 15. The rock feed and the rotational velocity and slope of kiln 13 determine the dwell time and are adjusted so as to cause the rock material to be heated to an appropriate value, depending on the rock material, by the time it exits the kiln, at which point it drops into centrifuge 40 to be described later. The exit opening of kiln 13, the input opening of centrifuge 40, and the path between are encompassed by an enclosure 16, FIG. 2, which prevents either the escape of the conditioning gas to the atmosphere, or the entrance of air as the rock material is conveyed from the kiln to the centrifuge. However, at least a portion of the conditioning gas may be permitted to descend into centrifuge 40 to serve as oil-replacement gas, providing it is sufficiently pressurized to readily permeate the rock.

Figure 2:
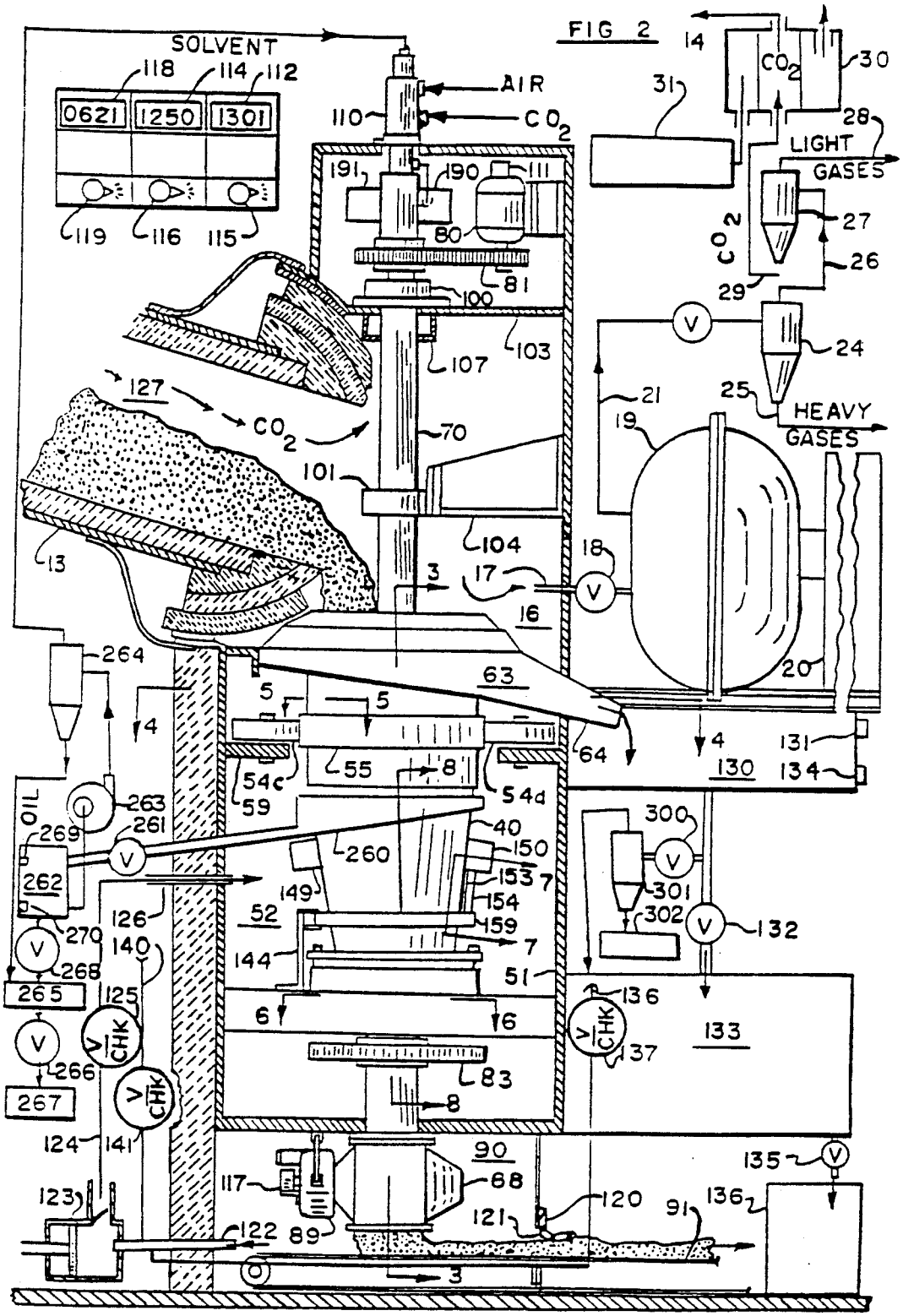

The principal supply of conditioning gas is obtained by recycling conditioning gas which exits kiln 13 by way of conduit 17 and valve 18, FIGS. 1 and 2. The conditioning gas is pressurized in gas compressor 19, which is driven by hydraulic motor 20. The supply of conditioning gas exiting compressor 19 by way of conduit 21 will usually be intermixed with some of the lighter hydrocarbons which may initially reside in the rock and which are vaporized from the rock in kiln 13. As an option, these may be removed from the conditioning gas stream by means of a conventional gas cyclone or gas centrifuge 24 wherein those gases heavier than the conditioning gas will be separated and will exit the bottom through conduit 25 from whence they may then be recovered, if desired, by conventional means. The conditioning gas stream will then be conducted by conduit 26 to a second cyclone or centrifuge 27 wherein the gases lighter than the conditioning gas may be removed through conduit 28 from whence they may then be recovered, if desired, by conventional means. The conditioning gas stream exiting cyclone or centrifuge 27 is then conducted by way of conduit 29 to heat exchanger 30 where it is heated by any conventional method, such as by hot gases or steam exiting heater 31. The heated conditioning gas then enters conduit 14 where it is conducted to kiln 13, as described previously. The effluent gases exiting heat exchanger 30 may be wasted or may be utilized to produce steam in a boiler to produce electricity. As another option, they may be conducted by conduit 32, FIG. 1, along with the gases in conduits 25 and 28, to pipeline 33 wherein they may then be cryogenically separated so as to avoid pollutants entering the atmosphere by a process as described in Nielson, U.S. Pat. No. 4,728,341.

The heated rock material drops into centrifuge 40, which is rotating at a selected speed to provide optimum bitumen production. This, depending on the particular rock material and apparatus utilized, will be within the range of from 100 RPM to 4000 RPM providing a centrifugal force ranging from 3.4 to 5456 multiples of gravity. For the rock material from Asphalt Ridge, Utah, a typical value would be 150–250 RPM.

Figure 3:
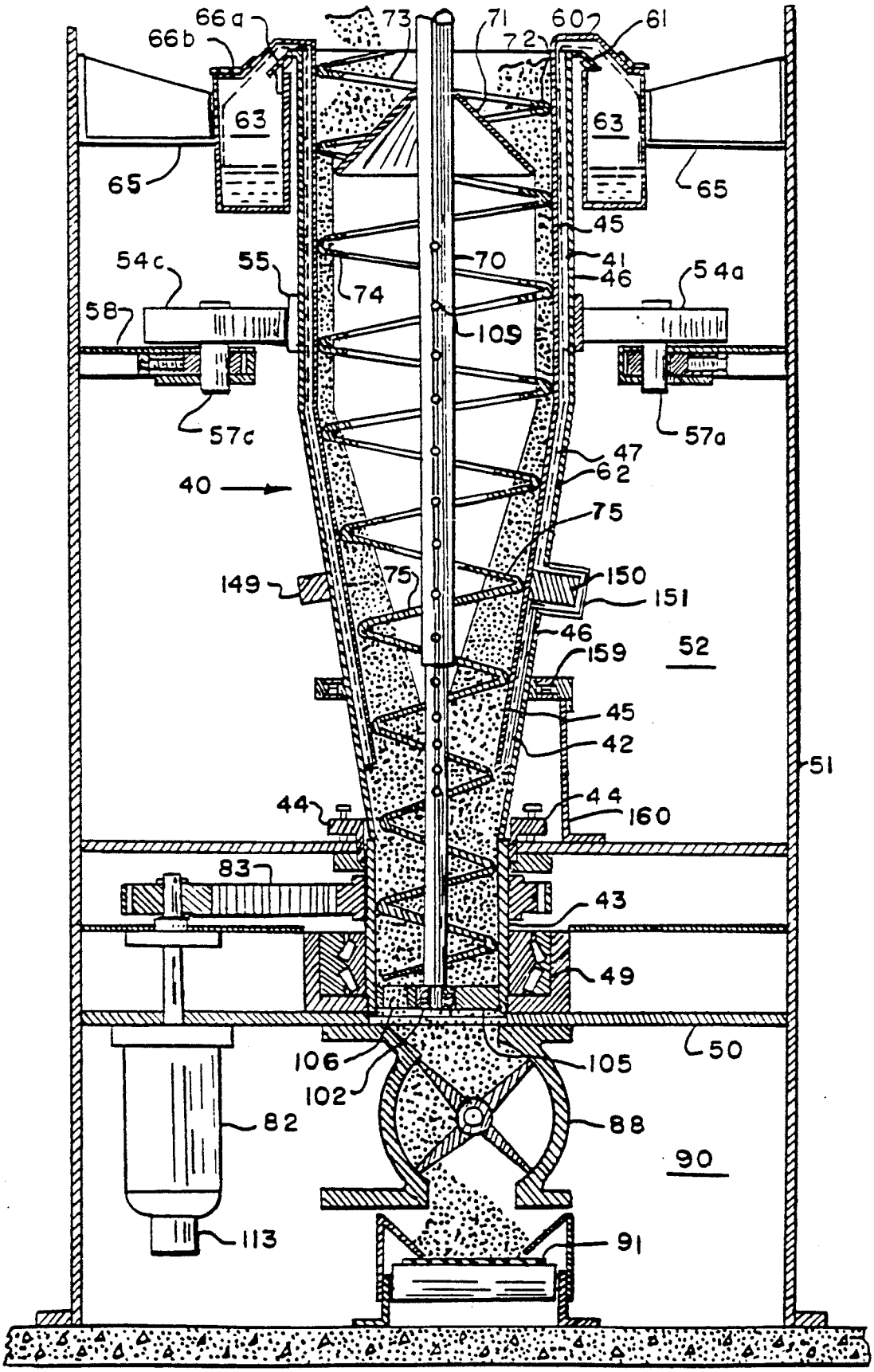
Figure 5:
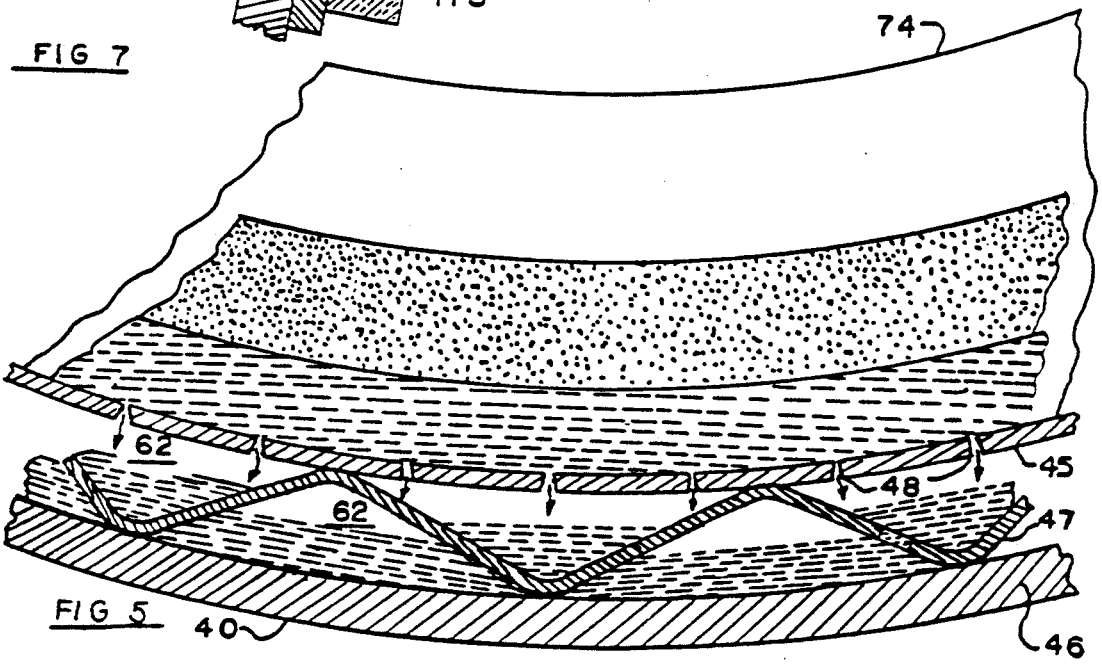

Centrifuge 40 comprises a cylindrical section 41, a truncated cone section 42, and a cylindrical end-bearing section 43, FIG. 3. Cylindrical section 41 and truncated cone section 42 have a common inner wall 45 and a common spaced apart outer wall 46, FIGS. 3 and 5. Separating the two walls is a corrugated steel cylindrical member 47. Inner wall 45 is fashioned from highly hardened stainless steel. Outer wall 46 and section 43 are fashioned from high strength steel plate or tubing. Inner wall 45 has a series of apertures 48, FIG. 5, extending over substantially its entire area. Apertures 48 are spaced apart and have opening sizes as required for optimum bitumen production with acceptable solids content in the product. Typically, they are spaced apart approximately one inch in both directions and are tapered such that the diameter at the inner surface is approximately 1/16 inch and at the outer surface, is approximately 3/32 inch. The taper serves to inhibit the trapping of rock particles in the aperture.

End-bearing section 43 is an extension of outer wall 46 and is configured as shown in FIG. 3. It is supported by a combination two-directional thrust and radial bearing 49, which in turn is supported by radial platform 50 attached to the wall of an enclosing outer cylinder 51, which is fashioned from high strength steel plate or tubing. Gas seals 44 are provided to prevent leakage of gas from chamber 52.

Figure 4:
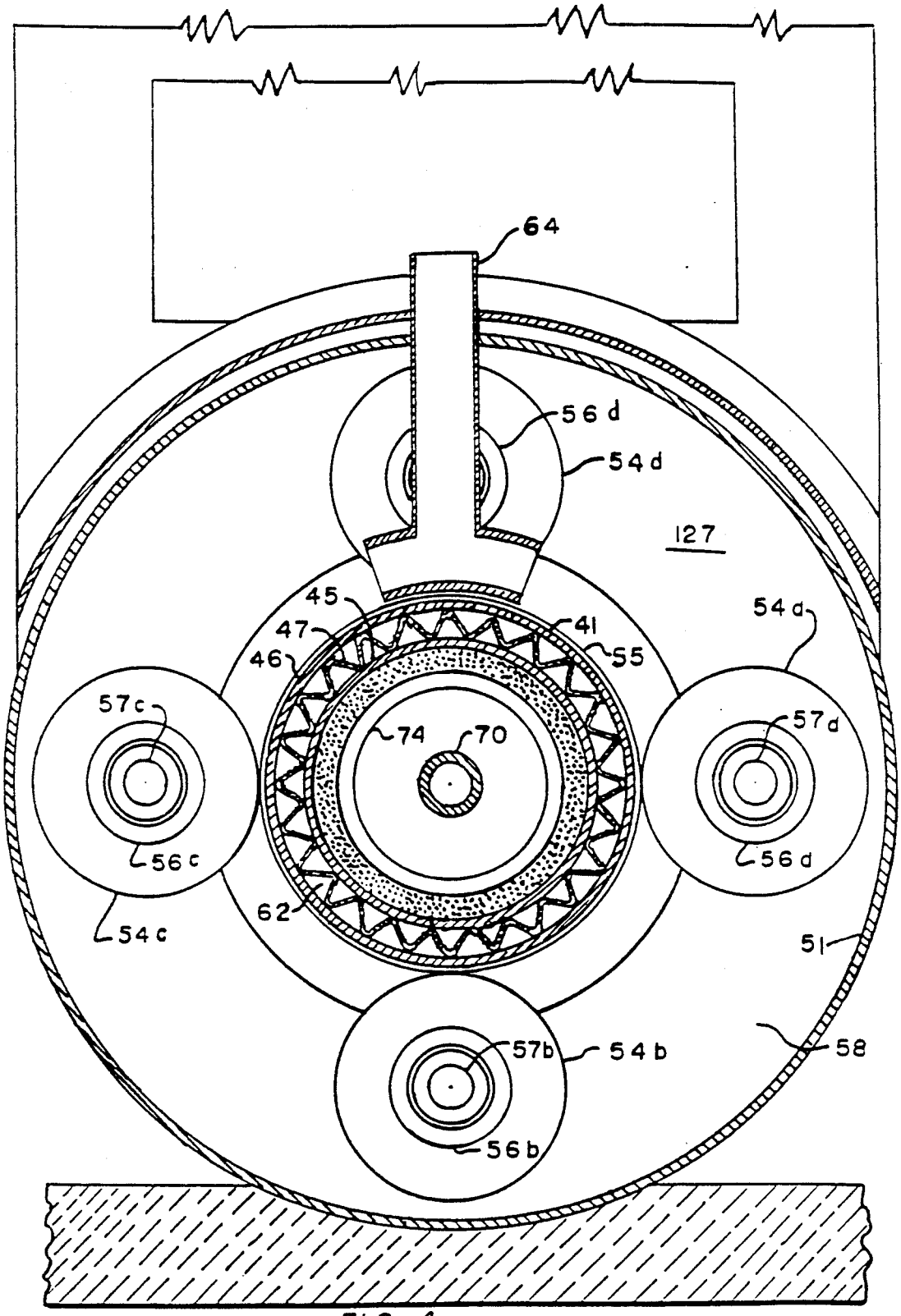

The cylindrical section 41 of centrifuge 40 is stabilized by four rollers **54*a*–54*d*, FIGS. 3, and 4, which bear against annular ring 55 attached to outer wall 46 of section 41, and which have internal bearings 56*a*–56*d*, journaled to shafts 57*a*–57*d*, which in turn are adjustably supported on annular ring 58 that is attached to cylinder 51**.

The upper end of inner wall 45 has an annular downward-facing deflector member 60 attached to it as shown, FIG. 3. The upper end of outer wall 46 has a corresponding annular deflector member 61 attached to it and spaced apart from member 60 as shown. Thus, hot bitumen, which is driven through apertures 48, FIG. 5, by centrifugal force, rises in passageways 62 formed by corrugated member 47 between inner wall 45 and outer wall 46 and is deflected downwardly and into annular trough or launder 63, from whence it then flows to spout 64, FIG. 2. Launder 63 is supported from cylinder 51 by means of brackets 65, FIG. 3. Since launder 63 is stationary and annular members 60 and 61 are rotating, there must necessarily be a space between them. This space is covered by splash flaps **66*a* and 66*b* serving to prevent hot bitumen from splashing out of launder 63**.

The centrifuge 40, along with its bearings, supports, drive motor, and other items, is enclosed in outer cylinder 51 as shown in FIGS. 2 and 3. Normally, centrally positioned within cylinder 51, and extending axially through centrifuge 40, is a rotating tubular shaft 70, which rotates at a speed preferably approximately 10 to 100 RPM faster or slower than the centrifuge. Attached to shaft 70, and positioned at a location close to but somewhat lower than the upper end of centrifuge 40, is a truncated cone shaped diverter 71, FIG. 3. As the heated rock is dumped into centrifuge 40, the diverter 71 urges it towards the wall 45 where it falls on the first conveyor screw member 72 of a three-part feed screw conveyor 73 which is driven by shaft 70. The flights of screw member 72 have a width equal to the rock layer thickness determined to be optimum for the particular rock material to be processed and the speed of the centrifuge, and a pitch of approximately 8 inches or as required. The second conveyor screw member 74 commences just below diverter 71 and has flights having a width equal to or somewhat greater than the flights of member 72, also with an 8 inch pitch or as required, and extending down to the lower end of cylindrical section 41. The third conveyor screw member 75 has flights which have an increasing width until they are full width at their lower portion and are tapered so as to match the contour of cone-shaped section 42 and cylindrical section 43. The pitch of this screw member is usually eight inches although it may be more or less, or even variable, depending on the particular rock to be processed and flow rate of the rock.

In operation, shaft 70 is preferentially driven by a reversible, variable speed, hydraulic motor 80 through chain drive 81, FIG. 2. Motor 80 is a hydraulic, reversible, fixed displacement motor with a pressure and temperature compensated, flow control valve 80*a*, FIG. 1, remotely positioned. Thus, as shaft 70 rotates with respect to centrifuge 40, the rock is centrifugally forced against wall 45 and is also driven axially downwardly by the action of feed screw conveyor 73. The frictional force of the rock material against centrifuge 40 tends to cause it to also rotate, and, if left unrestrained, would approach the speed of shaft 70. However, it is preferred that the speed of the centrifuge be maintained at a controlled speed somewhat different than the speed of the screw conveyor, preferably about 10 to 100 RPM less. This is accomplished by driving centrifuge 40 by hydraulic motor 82, FIG. 3, which drives end bearing section 43 through chain drive 83. The speed and adjustable oil pressure of motor 82 are controlled by hydraulic fluid received from supply tank 82*a* through conduit 84, FIG. 1, and then through pressure and temperature compensated, flow control valve 82*b*, motor 82, and variable resistance 85 into tank 86. The remainder of the hydraulic system is of conventional configuration, as depicted in FIG. 1, and is not described further herein. Pressure in tank 82*a* is maintained at an adjustable constant pressure by regulated relief valve 86*c* with hydraulic pump 87, driven by motor 87*a*, capable of delivering a volume in excess of demand and normally adjusted to deliver a volume just slightly greater than demand.

When the rock reaches the bottom of the centrifuge it is dumped into rotary airlock feeder 88, which is driven by a variable-speed-shaft-mounted hydraulic torque arm 89, FIGS. 1 and 2, with fixed hydraulic displacement and thence into discharge enclosure 90 and deposited on belt conveyor 91, which carries it away for further processing or disposal. By the time the rock has reached the bottom of centrifuge 40, substantially all of the bitumen and any associated precious metals will have been driven out by centrifugal force through apertures 48 in wall 45 and into passageways 62 between walls 45 and 46, and thence upwards and into launder 63.

Figure 6:
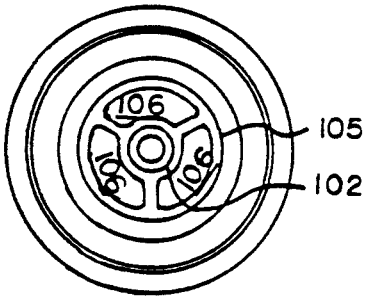

Shaft 70 is positioned and supported by bearings 100 and 101, FIG. 2, and 102, FIG. 3. Bearings 100 and 101 are supported by platforms 103 and 104 attached to cylinder 51. Bearing 100 may be protected from excess heat by cooling jacket 107. Bearing 102 is supported by spider 105, FIG. 3, which is attached to end-bearing section 43. Spider 105 has openings 106 through which the spent rock may pass, FIG. 6.

In this embodiment, as noted above, a portion of the conditioning gas which exits kiln 13, if sufficiently pressurized to readily permeate the rock, will enter centrifuge 40 and will then descend and serve as oil-replacement gas. However, as an option, shaft 70 has a number of transverse small holes 109 provided along its length, FIG. 3, thus, serving as a sparger. Pressurized oil replacement gas is then introduced into the upper end of shaft 70 by way of a rotating union 110, FIGS. 1 and 2, and then exits through holes 109 and impinges on, and permeates through, the rock, thus serving to assist in forcing the bitumen to be separated from the rock, and also serving to fill the voids left by the vacating bitumen.

The utilization of oil-replacement gas is unique to this process, and very important in this process, particularly when separating bitumen from oil-bearing rock material, since the bitumen is initially trapped in very small pockets within the rock material and would resist leaving such pockets if there were no oil-replacement gas to serve as its replacement since, otherwise, a vacuum would tend to be left behind. As can be appreciated by those skilled in the art, such tendency to form a vacuum would effectively inhibit the escape of the bitumen.

It is also important to note that the feed material processed by the process of this invention comprises rock material with only a small percentage of its bulk being oil trapped therein. The typical centrifuge normally employed in other processes utilizes feed material in the form of a slurry, having 20% to 90% liquids, and is adapted to separate the solid material of the slurry from the liquid material of the slurry. Such a centrifuge would not perform a useful separation of bitumen from oil-bearing rock material since the bitumen and rock do not form a slurry.

A tachometer 111, FIG. 2, is mounted on motor 80 and provides a readout of the screw conveyor speed on indicator 112. A second tachometer 113 is mounted on pump 82, FIG. 3, and provides a readout of the centrifuge speed on indicator 114. Control knobs 115 and 116 are used to control the speed of the motor and the pump by conventional means, not shown here. Optionally, conventional automatic means, not shown, may also be incorporated to maintain the desired speeds, and also the differential speed between the screw conveyor and the centrifuge, if desired. Additionally, a tachometer 117, FIG. 2, is mounted on extended shaft of valve 88 and provides a readout on indicator 118. Control knob 119 is used to control the speed of torque arm 89, all by conventional means.

Some gas will enter discharge enclosure 90, FIG. 2, along with the spent rock. A seal 120 at rock exit opening 121 serves to prevent the majority of this gas from exiting along with the rock. A recovery conduit 122 will convey most of the gas out of discharge enclosure 90 and into gas pump 123 wherein it will be pressurized and pumped through conduit 124, check valve 125, and conduit 126 back into compartment 52, which is the space inside cylinder 51.

The heated and pressurized bitumen exiting spout 64 falls into collection tank 130, FIG. 2. When the bitumen reaches the level of high limit switch 131, valve 132 is opened, valve 300, to be described later, remains closed, and the bitumen is discharged into holding tank 133. Discharge continues until the bitumen level reaches low limit switch 134 at which point valve 132 is closed. Holding tank 133 is maintained at atmospheric pressure. When ready for shipment, valve 135 is opened and the bitumen is discharged into oil carrier 136, which may be a railroad car, truck, or pipeline.

As the bitumen discharges through valve 132 into holding tank 133, conditioning gas previously dissolved or absorbed into the bitumen will be evolved, due to the decrease in pressure. This is conducted by conduit 136, FIG. 2, through check valve 137 and recycled back into the system at any convenient point, such as conduit 122. Makeup conditioning gas is introduced at any convenient location, such as by way of conduit 140 and check valve 141 into conduit 122.

In another embodiment of the invention, means for imparting a high frequency vibration to the rock material in the centrifuge is incorporated. It is known that the rate of flow of a viscous fluid through a porous solid is significantly enhanced by high frequency vibration. This is tantamount to decreasing the viscosity of the fluid. In addition the vibration of the rock greatly increases its fluidity.

Figure 7:
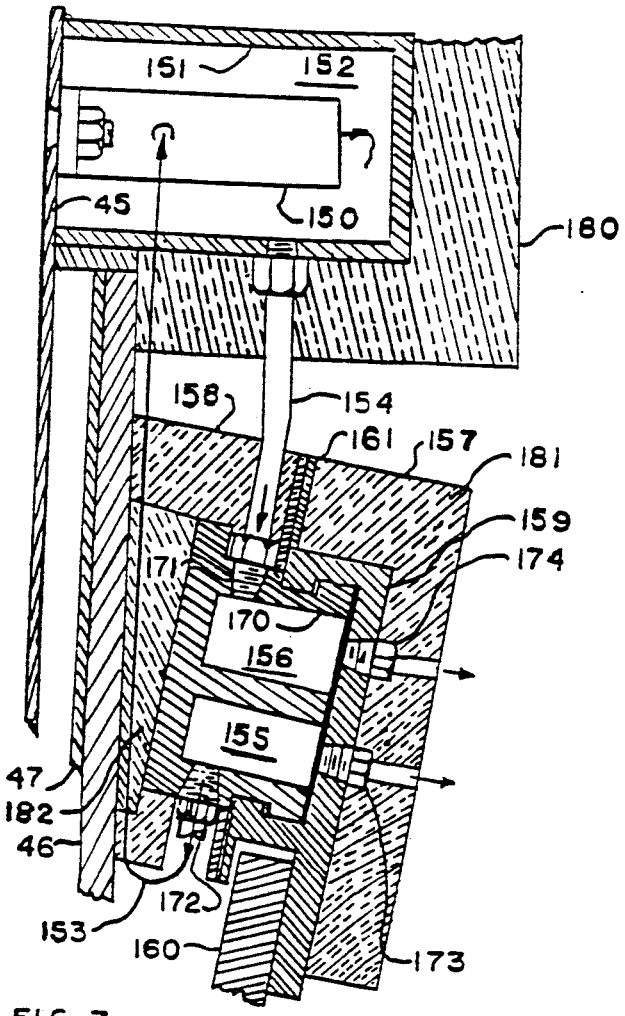

This is effected in the apparatus of this invention by attaching a vibrator to the centrifuge, and, optionally, a second vibrator to the rotating shaft. One or more vibrators 150, FIGS. 3 and 7, are attached to inner wall 45 projecting through matching cutouts in outer wall 46 and corrugation 47. Each of these vibrators may comprise any standard suitable vibrator, such as Model UCV-19, manufactured by Martin Engineering Co., U.S. Route 34, Meponset, Ill. 61345, which incorporates a ball circulating rapidly in a circular ball-race, driven by compressed air. Inasmuch as vibrators of this type are well known in the art, they are not described further herein. Corresponding counterbalancing counterweights 149 are attached to outer wall 46, FIG. 3. Vibrator 150 is housed in housing 151, FIG. 7, which is also attached to inner wall 45 and forms enclosure 152. Compressed air is supplied to vibrator 150 through conduit 153 and exits from enclosure 152 through conduit 154. Conduits 153 and 154 communicate, respectively, with air storage chambers 155 and 156, which are fashioned internally in a slip feed ring assembly 157. Slip feed ring assembly 157 is an annular assembly which encircles centrifuge 40, and which comprises a rotating portion 158 which is attached to outer wall 46 of centrifuge 40, and a stationary portion 159 which is supported by bracket 160. For clarity, the line of demarcation 161 between the stationary portion and the rotating portion is shown emboldened in FIG. 7. The rotating portion 158 comprises an annular member 170 which is fashioned so as to form the upper, lower, and inner walls of chambers 155 and 156, and which has ports 171 and 172 for receiving conduits 154 and 153, respectively. The stationary portion 159 is fashioned so as to form the outer wall of chambers 155 and 156, and which has ports 173 and 174 for supply and exhaust means, respectively, for the compressed air.

As an alternate to compressed air, other gases, such as nitrogen or carbon dioxide, may be utilized. Preferably the gas is supplied at a temperature below ambient so as to remove heat from the vibrators. For this reason insulation 180 is preferably placed around housing 151. Likewise, insulation such as 181 and 182 is preferably placed around feed slip ring assembly 157. The bearing surfaces between rotating portion 158 and stationary portion 159 may be lubricated by any conventional means (not shown), or alternatively, self lubricating materials may be employed.

As an option, a separate similar vibrator 190 may be attached to shaft 70, FIG. 2, and counterbalanced with counterweight 191. Compressed air is supplied to vibrator 190 through rotating union 110 from an external source not shown.

As noted above, the use of one or more vibrators will significantly enhance the rate of flow of the bitumen out of the rock. In addition, the flow of the bed of rock particles downwards through the centrifuge will be greatly enhanced.

An alternate and simplified embodiment of the centrifuge is shown in FIG. 8. This embodiment is particularly appropriate when the conditioning gas is supplied at a relatively low pressure, such as 15 psi to 50 psi.

In this embodiment centrifuge 200 has straight walls with no taper, thus differing from the previous embodiment. As a consequence the walls 201 and 202 of the centrifuge have the same diameter at the bottom of the centrifuge as at the top. Additionally, screw conveyor 204, one flight only being shown, FIG. 8, has the same diameter throughout its length. The inner wall comprises a first annular screen 201 of approximate forty-mesh. This screen bears against a second annular screen 203 of approximate ten-mesh, which in turn bears against outer wall 202, FIGS. 8 and 9. Screen 203 comprises two layers of spaced-apart wires one layer of which has wires disposed horizontally and the other layer of which has wires disposed vertically, thus providing vertically disposed passageways for oil to flow therethrough. Thus, in this embodiment, oil is forced through the first screen 201, the rock being retained, and is conducted into the vertically disposed passageways formed in second screen 203, which passageways serve the same purpose as the passageways 62, FIG. 5, of the previous embodiment.

A simplified seal is employed, comprising a circumferential pneumatic tire 205 grasped by a rim 206, FIGS. 8 and 10, which is journaled on shaft 70 by way of members 207 and 208, member 207 being attached to rim 206 and member 208 being attached to shaft 70. In operation, member 208 rotates with shaft 70 and member 207 rotates with centrifuge 200, the sliding surfaces being shown emboldened for clarity. Tire 205 has preferably a smooth polyurethane tread having high abrasion resistance, and is fashioned, preferably, from a glass fiber silicone rubber having a high temperature resistance suitable for operation up to 600° F.

Tire 205 is forced against the spent rock 209, FIG. 8, by compressed air supplied by way of pipe 210, positioned within drive shaft 211 and communicating with an external supply (not shown) by way of conduit 212 and rotating union 213. Rotating union 213 has two separate passageways, one of which communicates with pipe 210 and conduit 212, and the other of which communicates with annular space 214 surrounding pipe 210 and a separate conduit 215, which in turn communicates with a separate external supply (not shown) of compressed air. This separate supply of compressed air is channeled through conduit 216 and is utilized to drive a vibrator 217, for reasons described previously.

The spent rock exits the bottom of centrifuge 200, FIG. 8, through openings 220 in spider 221, and is deflected by plate 222 into receptor 223. A seal 224 is incorporated between shaft 211 and plate 222.

Drive shaft 211 is supported by self-aligning bearing 226 supported by bracket 227. Shaft 211 is driven by sprocket 228, chain 229, sprocket 230, and fixed displacement hydraulic motor 231, which in turn is supported on frame 232. The speed of drive shaft 211 is sensed by proximity switch 233 mounted on bracket 234 with collar 235 having metal extension 236, which in turn is attached to drive shaft 211.

Although the screens and seal as described above are depicted with the embodiment of FIG. 8 they would be equally applicable to the embodiment of FIG. 1.

As indicated previously, the individual rock particles of the sands frequently have a thin film of connate water surrounding them. This facilitates recovery of the bitumen since the water significantly reduces the tendency of the bitumen to adhere to the rock. For this reason it is preferable to utilize temperatures and pressures below the boiling point of water so as to preserve this film of water, as indicated previously. However this may not always be feasable. Furthermore, oil shales and also some tar sands may not have this film of connate water. In such instances it may prove economical or desirable to recover the residual bitumen which is still adherent to the rock subsequent to centrifuging. At least one reason for so doing is to provide a discharge of clean spent rock, thus minimizing pollution problems and aiding in possible further processing. This can be effected by an embodiment utilizing a solvent wash as described herein and as depicted in FIG. 8. Although the details are shown in the emboidiment of FIG. 8, they are equally applicable to the embodiment of FIG. 2.

A rotating union, not shown in FIG. 8 but see 110, FIG. 2, is constructed so as to have a channel inside shaft 70 which carries a pressurized gaseous or liquid solvent such as paint thinner to solvent sprayer 250, FIG. 8, which in turn comprises an annular chamber 251 having a trapezoidal cross section, a series of jet spray openings 252 passing through its outer wall, and a circumferential opening passing through its inner wall which communicates with a series of small openings 253 passing through the wall of shaft 70, all as depicted. Thus, in operation, the solvent is sprayed through jet spray openings 252 against the partially depleted rock, where it dissolves or mixes with bitumen remaining adherent to the rock and carries such bitumen into the vertically disposed passageways of the second screen 203. In order to prevent this solution or mixture of solvent and bitumen from mixing with the previously extracted bitumen, a partitioning ring 254 is positioned as shown. This mixture is then directed by deflecting members 255 and 256 into launder 257 having splash flaps 258 and 259, and thence into pressure tank 260 from which it is later withdrawn through a pressure reducing valve 261 into a holding tank 262. From such tank, it is intermittently withdrawn by pump 263 and introduced into cracking tower or centrifuge 264 wherein the bitumen and any residual solids are separated from the solvent. When a solvent is utilized that dissolves the bitumen, a cracking tower is used. When a solvent is utilized that mixes with the bitumen, a centrifuge is used. The solvent is recirculated and the bitumen is introduced into storage tank 265, from whence it is withdrawn as needed through valve 266 into carrier 267. When desired, the solvent separation stage may be omitted, the mixture being withdrawn from holding tank 262 through valve 268 directly into storage tank 265. High and low level switches 269 and 270 control the withdrawal from holding tank 262.

As noted above, the solvent wash may be applied to the embodiment of FIG. 2 as well as the embodiment of FIG. 8. For clarity, items 260–270 are shown in FIG. 2 as well as FIG. 8.

RECOVERY OF PRECIOUS METALS FROM PRODUCED OIL

As noted previously, some deposits such as those of Asphalt Ridge, Utah, and P.R. Springs, Utah, are reported to contain commercial quantities of microscopic particles of precious metals. When processing such deposits, at least a portion of these metals will be driven out of the rock, intermixed with the oil in centrifuge 40, FIG. 2, and will enter collection tank 130. Limit switches 131 and 134 will then operate on valve 300 rather than valve 132, valve 132 remaining closed. The oil and intermixed precious metals then enter auxiliary centrifuge 301. The precious metals exit the bottom of centrifuge 301, along with most of the residual solids, and are collected in container 302, from where the precious metals may then be reclaimed by standard procedures. The majority of the oil will exit centrifuge 301 through its top and will then be discharged into holding tank 133.

It should also be noted that some portion of the precious metals may remain in the spent rock. In such cases, the spent rock will be cleaned with a solvent, as noted above, and discharged as oil-free rock that can be processed to recover the precious metals by conventional means.

PRODUCTION OF BITUMEN FROM TAR SANDS

When the oil-bearing rock material consists of tar sands, the conditioning gas is preferably $CO_2$ and is heated to a temperature of approximately 600° to 800° F. and pressurized to a pressure of approximately 210 psi. The rock feed and the rotational velocity and slope of kiln 13 are adjusted so as to cause the rock to be heated to approximately 380° F. by the time it exits the kiln. The conditioning gas exits kiln 13 at approximately 450° F. and 200 psi. At least a portion of this gas then descends into centrifuge 40 where it serves as oil replacement gas.

The elevated temperature significantly reduces the viscosity of the oil, and, in addition, the elevated pressure results in conditioning gas being dissolved or absorbed into the oil which further reduces the viscosity. As an example, the kinematic viscosity for the oil (bitumen) in the Asphalt Ridge, UT, deposits is reduced to approximately 17 centistokes, FIG. 11, when raised to a temperature of 380° F. Assuming the conditioning gas to be $Co_2$ at 200 psi, the kinematic viscosity is further reduced to approximately 11 centistokes, FIG. 12. This will allow the bitumen to flow readily, thus enhancing the efficacy of production by centrifuging.

PRODUCTION OF OIL FROM OIL SHALE

In this process, gaseous hydrocarbons of lower weight and bitumen are produced from oil shale, hereafter simply called rock. In this embodiment, the soaking gas, the conditioning gas, and the oil-replacement gas are preferably a mixture of lower weight hydrocarbons, preferably comprising a portion of these produced by the process itself.

The method and apparatus are substantially the same as described above for producing oil from tar sand except that the conditioning gas is heated to a temperature of approximately 1000° F. to 1200° F. before being introduced into the kiln and dwell time is adjusted so as to heat the rock to approximately 900° F. by the time it exits the kiln.

The gas exiting kiln 13 by way of conduit 17, FIG. 1, will now be comprised primarily of lower weight hydrocarbons, a large portion of which will be produced in the kiln due to pyrolysis of the rock. At least a portion of these will be diverted through conduit 142 to tank 143 for further processing or distribution by conventional means not described further herein. The remainder will enter compressor 19 and continue through the cycle as described before.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. Apparatus for continuously producing oil and hydrocarbon gases from oil-bearing rock material, comprising a kiln for producing hydrocarbon gases and conditioning said oil-bearing rock material in a conditioning atmosphere of a heated and pressurized conditioning gas substantially devoid of oxygen; means for introducing a conditioning gas into said kiln; a centrifuge for subjecting said conditioned oil-bearing rock material to centrifugal force, thereby producing oil intermixed with any precious metal particles associated with said oil in said rock material, leaving spent rock; means for introducing oil replacement gas into said centrifuge under pressure so as to subject said conditioned oil-bearing rock material to said pressurized oil-replacement gas within said centrifuge; means for enclosing said conditioned oil-bearing rock material and for conveying it from said kiln to said centrifuge; a feed screw conveyor adapted to move said oil-bearing rock material and spent rock axially along said centrifuge; means for collecting the produced oil and any intermixed precious metals; and means for discharging and accumulating said spent rock separately from said produced oil.

2. Apparatus according to claim 1, including means for recovering at least a portion of the hydrocarbon gases produced in the kiln.

3. Apparatus according to claim 1, including means for removing at least a portion of said conditioning gas from the kiln after the oil-bearing rock material has been preconditioned; and means for repressurizing and reheating the removed conditioning gas from the kiln and recycling it back into said kiln.

4. Apparatus according to claim 3, including means for conducting at least a portion of the conditioning gas from the kiln into the centrifuge so as to serve as oil-replacement gas.

5. Apparatus according to claim 1, having means for driving the feed screw conveyor at a selected and controlled rotational velocity having a differential of less than 300 RPM with respect to the rotational velocity of the centrifuge.

6. Apparatus according to claim 1, wherein the means for introducing oil-replacement gas under pressure so as to subject said conditioned oil-bearing rock material to said pressurized oil-replacement gas within said centrifuge includes a sparger into which oil-replacement gas is introduced, said sparger having spray means disposed within said centrifuge for spraying said oil-replacement gas against oil-bearing rock material in the centrifuge.

7. Apparatus according to claim 1, wherein the centrifuge has an inner annular wall with apertures passing transversely therethrough over at least a portion of its axial length and circumference; an outer annular wall spaced apart from said inner annular wall; and means for maintaining the spacing between said inner wall and said outer wall, said means incorporating one or more axially oriented passageways which permit the flow of oil and any intermixed precious metals produced from the oil-bearing rock.

8. Apparatus according to claim 7, wherein the inner annular wall comprises a metal plate having apertures passing therethrough which are tapered such that the opening at the inner surface of said inner wall is smaller than the opening at the outer surface of said inner wall.

9. Apparatus according to claim 7, wherein the means for maintaining the spacing between the inner wall and the outer wall comprises a corrugated member having axially oriented corrugations.

10. Apparatus according to claim 7, wherein the inner annular wall comprises a first screen of mesh fine enough to prevent the passage of the majority of the rock particles but coarse enough to permit the passage of oil.

11. Apparatus according to claim 10, wherein the means for maintaining the spacing between the inner wall and the outer wall comprises a second screen comprised of two layers of spaced apart wires one layer of which has its wires disposed horizontally and the other layer of which has its wires disposed vertically, thus serving as the axially oriented passageways which permit the flow of oil produced from the oil-bearing rock material.

12. Apparatus according to claim 7, wherein the means for collecting the produced oil and any intermixed precious metals comprises the axially oriented passageways betwen the inner wall and the outer wall of the centrifuge; a launder surrounding at least a portion of the outer wall of said centrifuge; a communication channel between said axially oriented passageways and said launder; an enclosed holding tank; and a conduit connecting said launder with said enclosed holding tank; all of the aforesaid being constructed and arranged such that produced oil will flow through said axially oriented passageways and into said launder, thence through said conduit into said holding tank while being enclosed or sealed to substantially prevent escape of said produced oil.

13. Apparatus according to claim 12, further comprising an oil carrier and having means for dispensing produced oil from the holding tank and conducting it to said oil carrier,; a collection tank operated at substantially ambient pressure; a conduit connecting said holding tank and said collection tank with a pressure reducing valve disposed intermediate the length of said conduit; high and low limit switches disposed in said collection tank for operating said pressure reducing valve; and a second conduit connecting said collection tank with said oil carrier, said second conduit having a discharge valve disposed intermediate its length.

14. Apparatus according to claim 12 having an auxiliary centrifuge for subjecting the produced oil and intermixed precious metals to centrifugal force, thereby producing said precious metals separately from said produced oil.

15. Apparatus according to claim 14, having means for dispensing produced oil and any intermixed precious metals from the holding tank to said auxiliary centrifuge; wherein said auxiliary centrifuge includes means for discharging said precious metals separately from said oil; a conduit connecting said holding tank with the auxiliary centrifuge; a pressure reducing valve disposed intermediate the length of said conduit connecting said holding tank with the auxiliary centrifuge; a receptacle for collecting said separated precious metals as discharged from said auxiliary centrifuge; an oil collection tank for collecting said oil which is separately discharged from said auxiliary centrifuge; and a second conduit connecting said auxiliary centrifuge with said oil collection tank.

16. Apparatus according to claim 1, wherein the feed screw conveyor comprises a drive shaft and one or more sequential conveyor screw members, each of which is attached to, and driven by, said drive shaft.

17. Apparatus according to claim 16, having two or more sequential conveyor screw members having differing flights.

18. Apparatus according to claim 16, wherein an annular deflector is attached to the feed screw conveyor drive shaft, said deflector having a truncated cone shape and being thereby adapted to deflect oil-bearing rock material introduced into the centrifuge outwardly away from the center of said centrifuge and onto a conveyor screw member.

19. Apparatus according to claim 1, wherein the means for discharging and accumulating the spent rock comprises a discharge enclosure disposed to receive spent rock as it exits the centrifuge; and a conveyor which conveys said exiting spent rock way from said discharge enclosure.

20. Apparatus according to claim 19, wherein the discharge enclosure encloses the exiting spent rock so as to minimize the escape of oil-replacement gas which accompanies said spent rock; and at least a partial seal means positioned at the point where the conveyor and said spent rock exit said discharge enclosure.

21. Apparatus according to claim 20, having means for recovering from said discharge enclosure at least a portion of the oil replacement gas which accompanies the spent rock discharged into said discharge enclosure from said centrifuge.

22. Apparatus according to claim 1, having means for recycling at least a portion of the conditioning gas discharged from said kiln and said centrifuge to said means for introducing a conditioning gas into the kiln, which means includes one or more gas cyclones or gas centrifuges positioned and having means for removing from said conditioning gas components which have a greater or lesser molecular weight than the constituents of said conditioning gas.

23. Apparatus according to claim 1, including vibrator means for vibrating at least a portion of the centrifuge and/or the feed screw conveyor, thus enhancing movement of the oil-bearing rock material and production of oil.

24. Apparatus according to claim 1, which includes means for directing a solvent against partially depleted oil-bearing rock material subsequent to removal of at least some of the oil by centrifuging, whereby said solvent forms a mixture or solution with residual oil which remained adherent to said rock subsequent to said centrifuging.

* * * * *